US005961240A

United States Patent [19]

Bobrovniczky

[11] Patent Number: 5,961,240

[45] Date of Patent: Oct. 5, 1999

[54] SCAFFOLDING CONNECTOR

[75] Inventor: Bert Bobrovniczky, Don Mills, Canada

[73] Assignee: Aluma Enterprises Inc., Downsview, Canada

[21] Appl. No.: 08/911,721

[22] Filed: Aug. 15, 1997

[51] Int. Cl.[6] ..... F16B 2/14

[52] U.S. Cl. ..... 403/49; 403/246; 182/186.8

[58] Field of Search ..... 403/49, 246, 256, 403/187, 189, 174, 178, 179; 182/186.7, 186.8, 175.5, 175.6, 179.1; 211/152

[56] References Cited

U.S. PATENT DOCUMENTS

| | | | |
|---|---|---|---|
| 4,083,640 | 4/1978 | Lovering | 403/246 |
| 4,348,128 | 9/1982 | Gostling | 403/49 |
| 4,493,578 | 1/1985 | D'Alessio | 403/49 |
| 4,522,527 | 6/1985 | Grandpierre | 403/49 |
| 4,530,616 | 7/1985 | Roux | 403/49 X |
| 4,587,786 | 5/1986 | Woods | 403/49 X |
| 4,867,274 | 9/1989 | Langer | 403/49 X |
| 4,958,702 | 9/1990 | Langer | 403/49 X |
| 5,127,757 | 7/1992 | Langer | 403/49 |
| 5,172,997 | 12/1992 | Brasil | 403/49 X |
| 5,207,527 | 5/1993 | Duncan et al. | 403/49 X |
| 5,217,314 | 6/1993 | Perruelle | 403/49 |

FOREIGN PATENT DOCUMENTS

| | | |
|---|---|---|
| 0 451 068 | 10/1991 | European Pat. Off. . |
| 1 521 232 | 4/1968 | France . |
| 2 520 482 | 7/1983 | France . |
| 2 723 153 | 2/1996 | France . |

*Primary Examiner*—Harry C. Kim

[57] ABSTRACT

The present invention is directed to a scaffolding connector for securement to the end of a horizontal member to releasably secure the horizontal member to a vertical post. The connector comprises a suitably dimensioned steel sheet folded and shaped to form a back plate for securement of the connector to the end of a horizontal runner, generally triangular shaped top and bottom plates extending outwardly from the back plates and side plates extending downwardly from the sides of the top and upwardly from either side of the bottom plate.

16 Claims, 8 Drawing Sheets

FIG. 6.
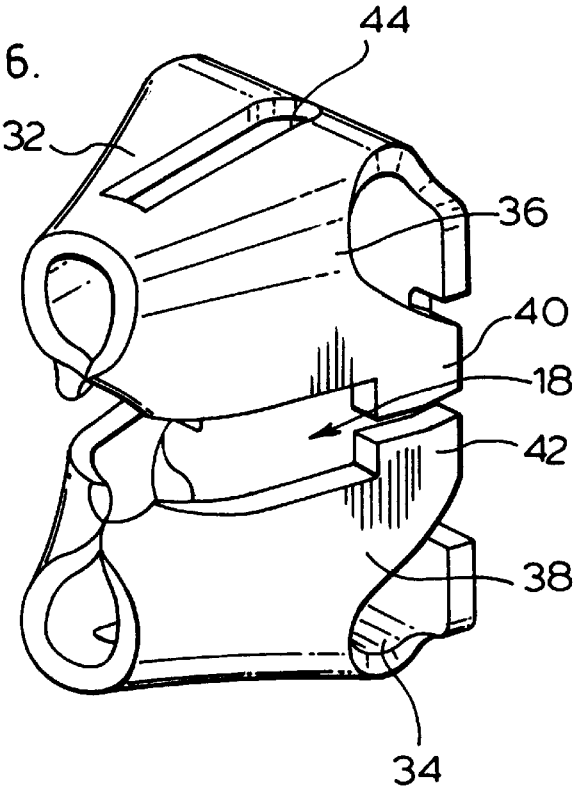
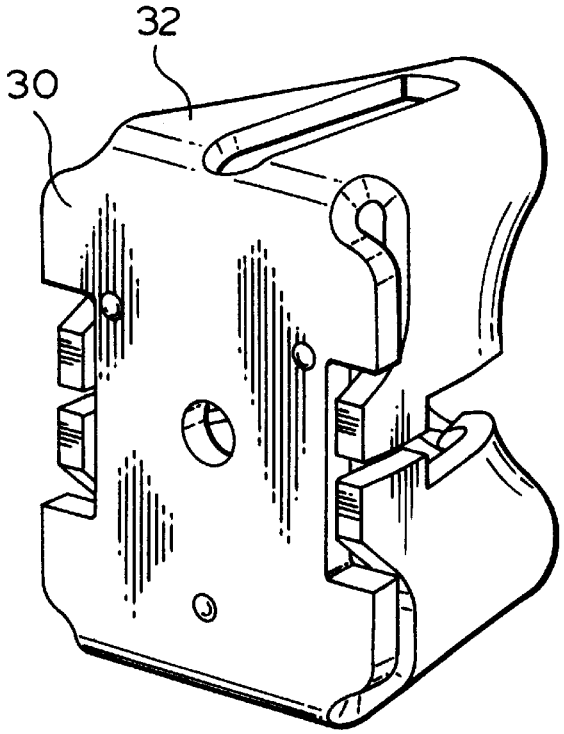
FIG. 7.

SCAFFOLDING CONNECTOR

FIELD OF THE INVENTION

The present invention relates to a scaffolding used in construction and other industries, and in particular, to an improved scaffolding connector for use with post and runner, or tubular type scaffolding.

BACKGROUND OF THE INVENTION

Post and runner, or tubular type scaffolding, has become commonly utilized, in part, due to the versatility of such scaffolding for forming irregular shapes. Such post and runner, or tubular type scaffolding, are scaffoldings composed of vertical upright posts connected together by horizontal cross pieces and possibly by oblique braces. The horizontal cross pieces are able to be connected to the vertical posts in many angular positions and are not limited to the generally perpendicular connection of conventional scaffolding made from welded end frames having two vertical legs and cross pieces. This type of connection gives rise to the versatility in forming in regular shapes in this scaffolding, not being limited to the generally rectangular shaping of the conventional end frames and cross pieces.

The horizontal cross pieces utilized in post and runner scaffolding are generally connected to the vertical upright posts by means of a suitable connector attached to the end of the horizontal cross piece and which connects with a suitable bracket or other such structure attached to the vertical upright post. The end connectors are generally provided with a wedge locking member which releasably locks the end connector to the bracket attached to the upright post. Examples of such structures are illustrated in U.S. Pat. No. 4,522,527, issued Jun. 11, 1985 to C. M. Grandpierre, U.S. Pat. No. 4,493,578, issued Jan. 15, 1985 to M. S. D'Alessio.

U.S. Pat. No. 4,493,578, in particular, describes a post and runner scaffolding where the connector is integrally formed from the end of the horizontal runner, or similar cross member. The connector has a longitudinally extending cross slot in its end of a width and depth to accommodate a ring flange affixed to the vertical post. The connector is also provided with cut-outs in the top and bottom to enable the connector to abut against the vertical post. The tubular wall of the horizontal member at the area of the connector has been reformed by flattening in an attempt to strength and stiffen the connector. The connector at the top and bottom are provided with slots through which a wedging locking member may pass.

SUMMARY OF THE INVENTION

The present invention is directed to a scaffolding connector for securement to the end of a horizontal member to releasably secure the horizontal member to a vertical post. The connector comprises a suitably dimensioned steel sheet folded and shaped to form a back plate for securement of the connector to the end of a horizontal runner, generally triangular shaped top and bottom plates extending outwardly from the back plates and side plates extending downwardly from the sides of the top and upwardly from either side of the bottom plate.

BRIEF DESCRIPTION OF THE DRAWINGS

Preferred embodiments of the present invention are illustrated in the attached drawings, in which:

FIG. 6 is a perspective view from the front of a connector of FIG. 1;

FIG. 7 is a perspective view from the rear of the connector of FIG. 1;

DETAILED DESCRIPTION OF THE PREFERRED EMBODIMENTS

Figure 1:
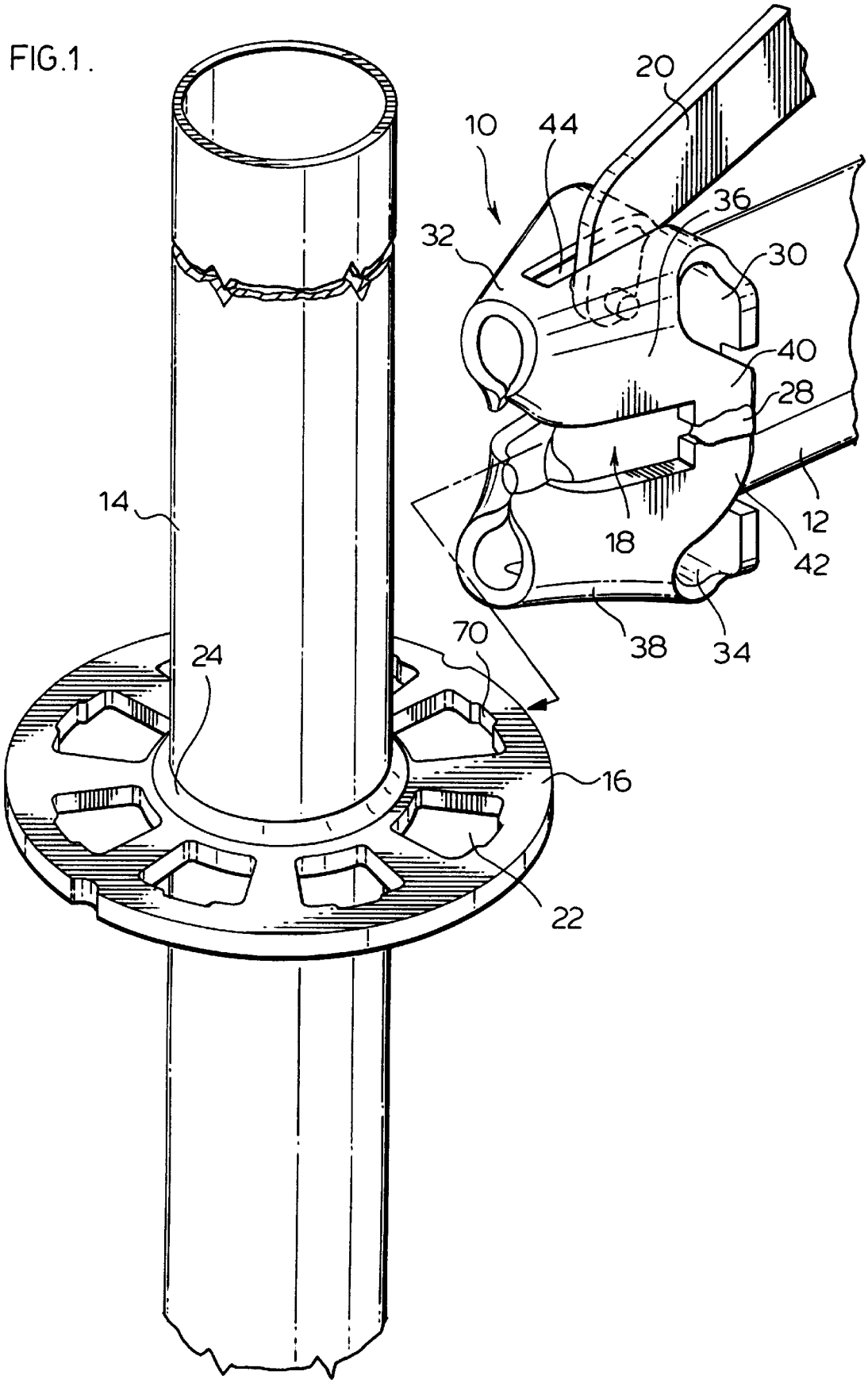
FIG. 1 is a perspective view of an embodiment of a scaffolding connector of the present invention and a vertical post.

A preferred embodiment of a scaffolding connector of the present invention is shown in the attached drawings, generally indicated by the numeral 10. As illustrated in FIG. 1, the scaffolding connector 10 attaches to the end of a horizontal member 12 of a scaffolding system. The scaffolding connector 10 connects the horizontal member 12 to a vertical upright 14 by being lockingly engaged with an attendant means provided on the vertical post 14 such as locking ring 16. Connector 10 is provided with a horizontal slot 18 which engages with the locking ring 16. A locking wedge 20 is provided which passes through an opening 22 in locking ring 16 and releasably locks the connector 10 to the locking ring 16. Typically, locking ring 16 is cast or formed and is attached to the vertical post 14 by welds 24.

As illustrated in the Figures, connector 10 is formed by bending or folding a suitably dimensioned steel plate, as will be explained further below. Connector 10 is attached to the horizontal member 12 by suitable means, such as for example, a weld 26.

As illustrated in the Figures, connector 10 has a back plate 30 for attachment to the horizontal member 12. Generally triangular shaped top 32 and bottom plates 34 extend outwardly from the back plate 30. Sides 36 extend downwardly from either side of the top plate 32 and sides 38 extend upwardly from the bottom plate 34. The edges of the sides 36 and 38 form the horizontal slot 18 of the connector. Sides 36 and 38 are provided with extension wings 40 and 42 which form the end of the horizontal slot 18 and which are brought into a close relationship with one another and with the back plate 30.

Top plate 32 is provided with a slot 44 through which the locking pin 20 passes. Similarly, bottom 34 is also provided with a slot 46 through which the locking pin may pass for engagement and disengagement of the connector 10 with the locking ring 16 as will be explained further below. Slot 44 in the top plate 32, preferably extends to the back plate 30 and may extend even slightly downwardly from the top of the back plate 30. Slot 44 is of a width to permit passage of the body of the locking wedge 20 therethrough while retaining the end of the body of the locking wedge within the interior of the connector 10 by means of the slot 44 being of sufficient narrowness to prevent the stop pin 50 associated with the locking wedge 20 to pass therethrough. Slot 46 and the bottom plate 34 is shorter in length than slot 44 but has a greater width than the slot 44 to permit the stop pin 50 to be able to pass through the slot 36 in the bottom plate 34.

Figure 8:
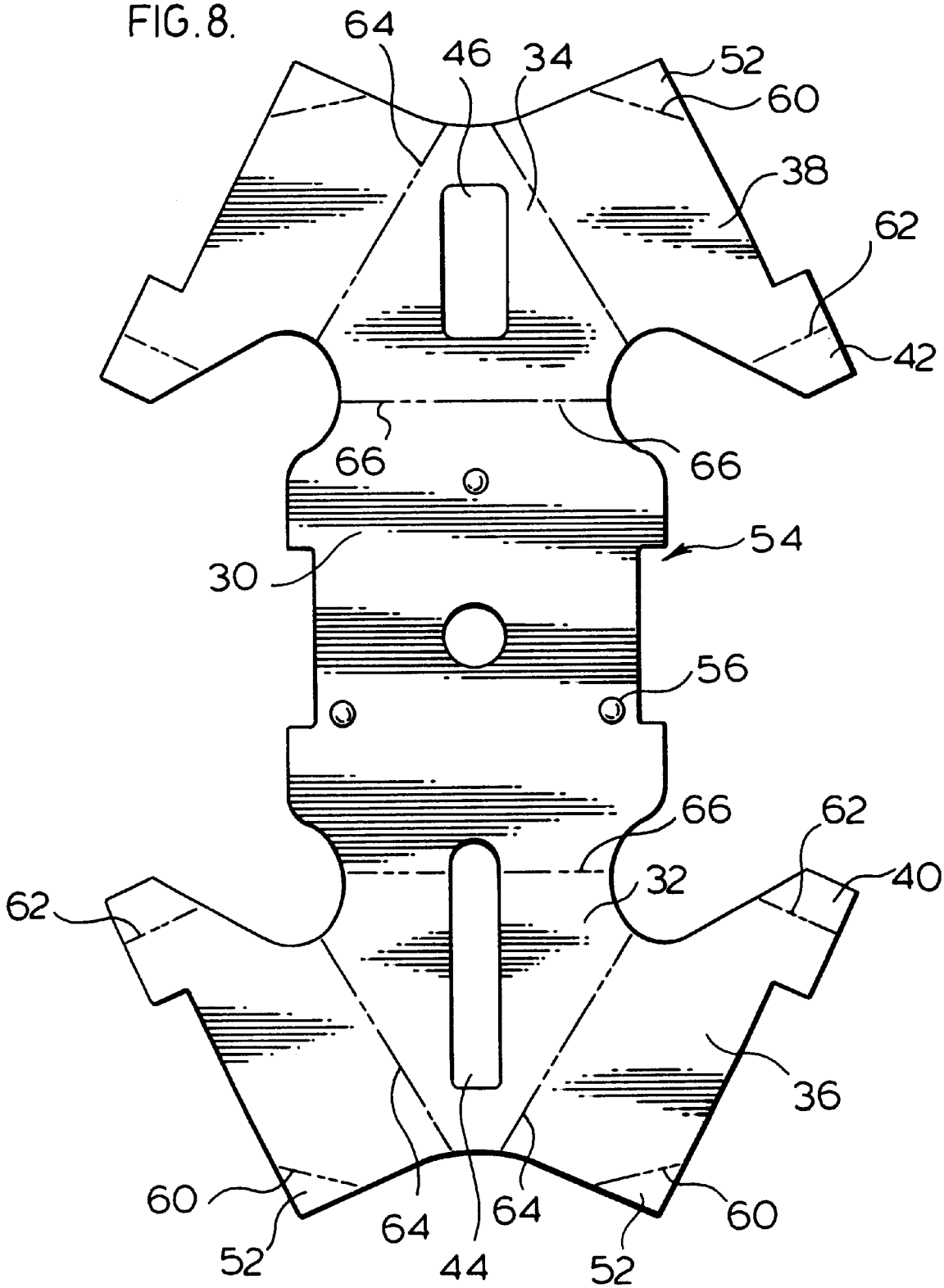
FIG. 8 is a top plan view of a blank for forming the connector of FIG. 1.

As illustrated in FIG. 8, connector 10 is formed by folding a suitably dimensioned steel sheet into the desired shape. The steel sheet is cut according to a pattern which will yield the desired shaping of the connector upon folding. In the preferred embodiment, illustrated in FIG. 8, the steel sheet, after being cut, is first folded along line 60 to form indents 52 which act as an alignment guide for aligning the connector 10 with the locking ring 16. The steel sheet blank is then folded along the second fold line 62 to turn the ends of the extension wings 40 and 42 slightly inwardly to lie within the slots 54 at the side of the back plate 30. The connector is then folded along line 64 to form the side 36 and 38 of the top and bottom plates 30 and 32. Finally, the connector is folded along line 66 to fold the top and bottom plates 32 and 34 outwardly from the back plate 30.

Figure 4:
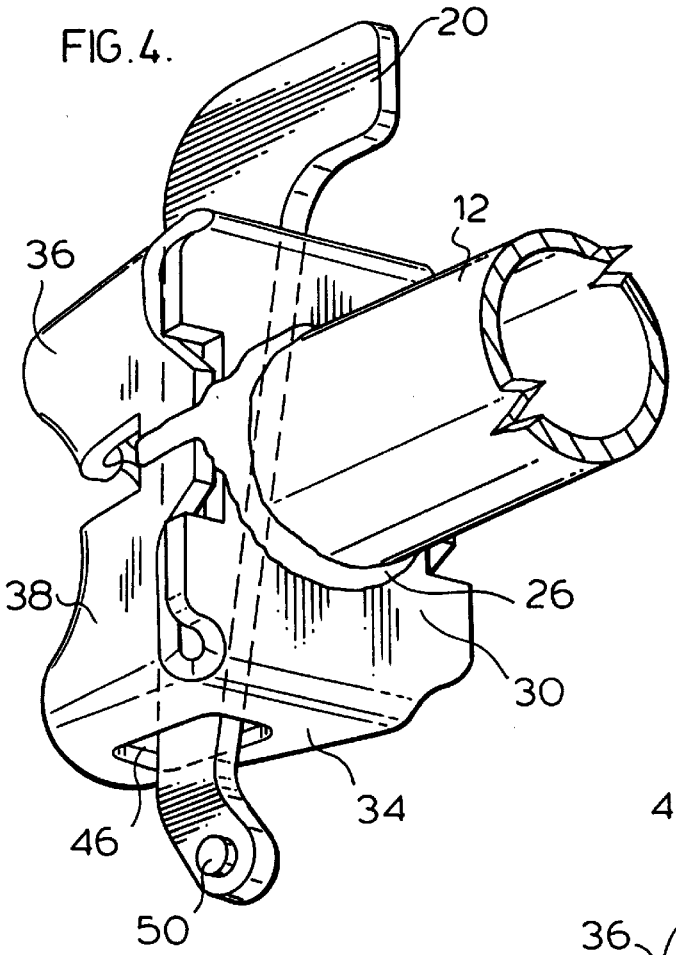
FIG. 4 is a perspective view of the connector of FIG. 1 and the locking pin.
Figure 5:
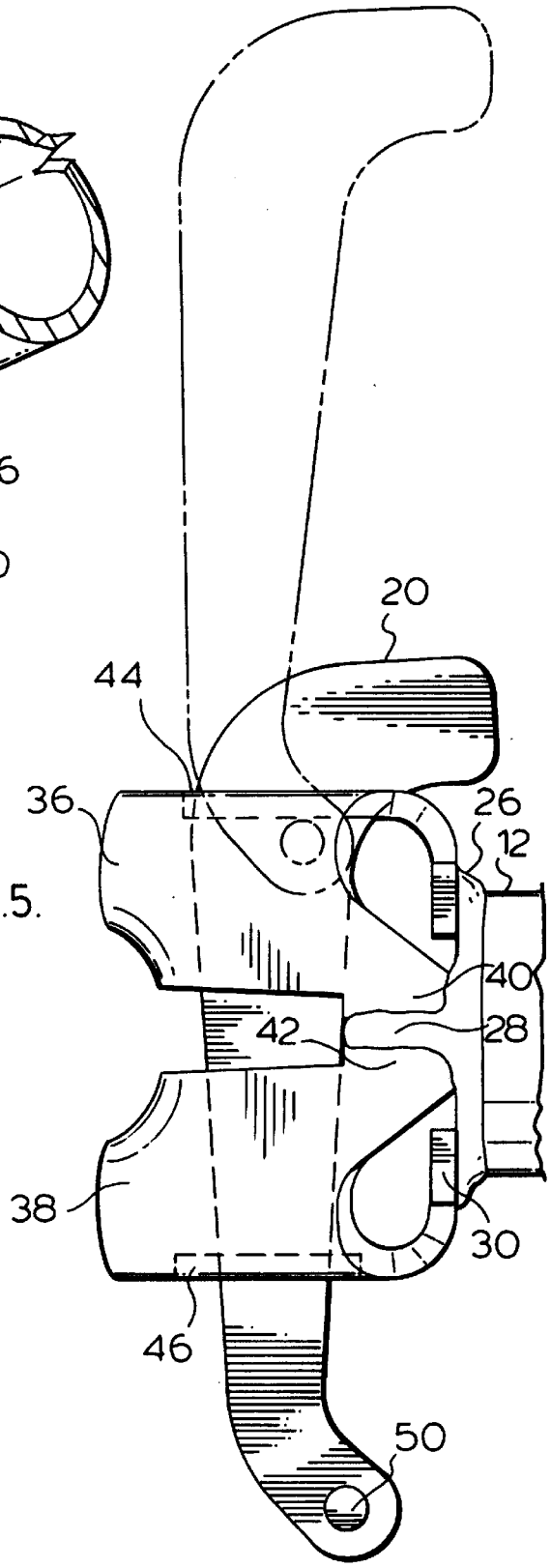
FIG. 5 is a side elevation view of the connector of FIG. 1 and locking pin.

As illustrated in the Figures, back plate 30 is preferably provided with alignment means such as dimples 56 for properly positioning the connector 10 on the horizontal member 12 for attachment thereto. As set out above, the connector 10 is attached to the horizontal member 12 by positioning the connector 10 at the end of the horizontal member 12 with the alignment means 56, located within the internal diameter of the tubing of horizontal member 12. Weld 26 is then applied at the junction between the back plate 30 of the connector 10 and the end of the horizontal member 12 to permanently attach the connector 10 to the horizontal member 12. Welds 28 are then applied in the gap between the extension wings 40 and 42 to securely connect the sides 36 and 38 to one another. The weld 26, shown in FIG. 4, connects the side wings 40 and 42 to the back plate 30 and maintains the position of these components. Weld 26 and/or weld 28 connect the side plates to each other and the back plate to oppose separation of the top plate 32 and the bottom plate 34. Thereafter, the locking wedge 20 is passed through openings 44 and 46 and the stop pin 50 attached to the locking wedge 20. This results in the completed and fully assembled horizontal member 12 with the end connector 10.

As illustrated in the Figures, and in particular FIGS. 1 through 3, the horizontal member 12 and the connector 10 are releasably attached to the vertical post 14 as follows:

The connector 10 is slid over the locking ring 16 at the location of one of the openings 22 by permitting the locking ring 16 to pass within the horizontal slot 18 of the connector 10. The locking wedge 20 which is held in the "up" position as shown in FIG. 1 is then pushed or dropped downwardly to pass through the opening 22 in the locking ring 16 and the slot 46 in the bottom plate 34 of the connector 10. Opening 22 is provided with a key way or indent 70 for engagement of the locking wedge 20. In this way, the connector is releasably secured and locked to the locking ring 16, thereby releaseably attaching the horizontal member 12 to the vertical post 14.

Connector 10 is provided at the front thereof with a slight concave shape which permits the connector 10 to abut the wall of the vertical post 14 and provides for a secure attachment of the connector and the horizontal member 12 to the vertical post 14. This slight concave shape is formed by providing a radius or concave shaping to the front of the sheet still blank as illustrated in FIG. 8.

Figure 2:
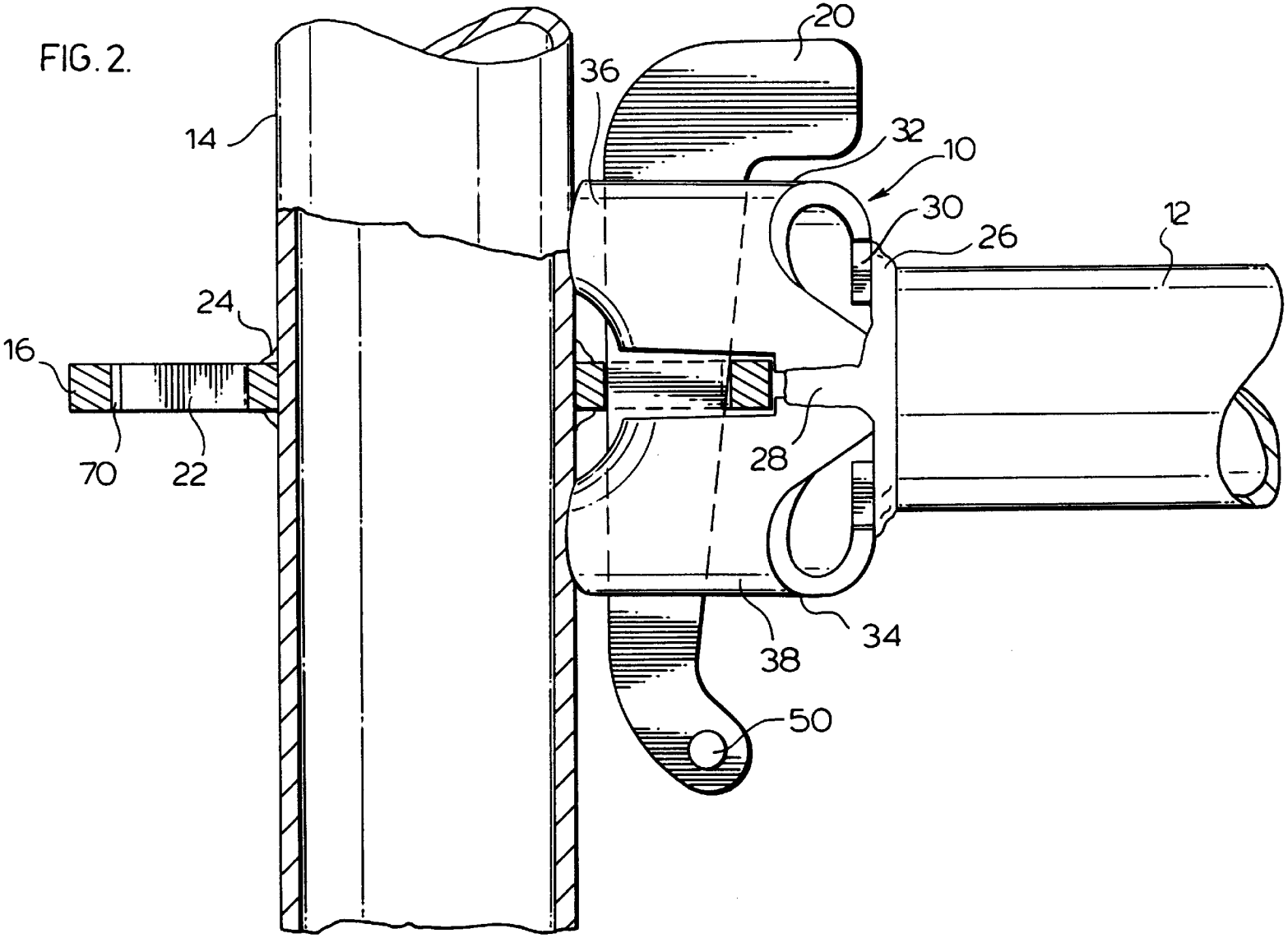
FIG. 2 is a side elevation view partly in cross section of the connector of FIG. 1 attached to a vertical post.
Figure 3:
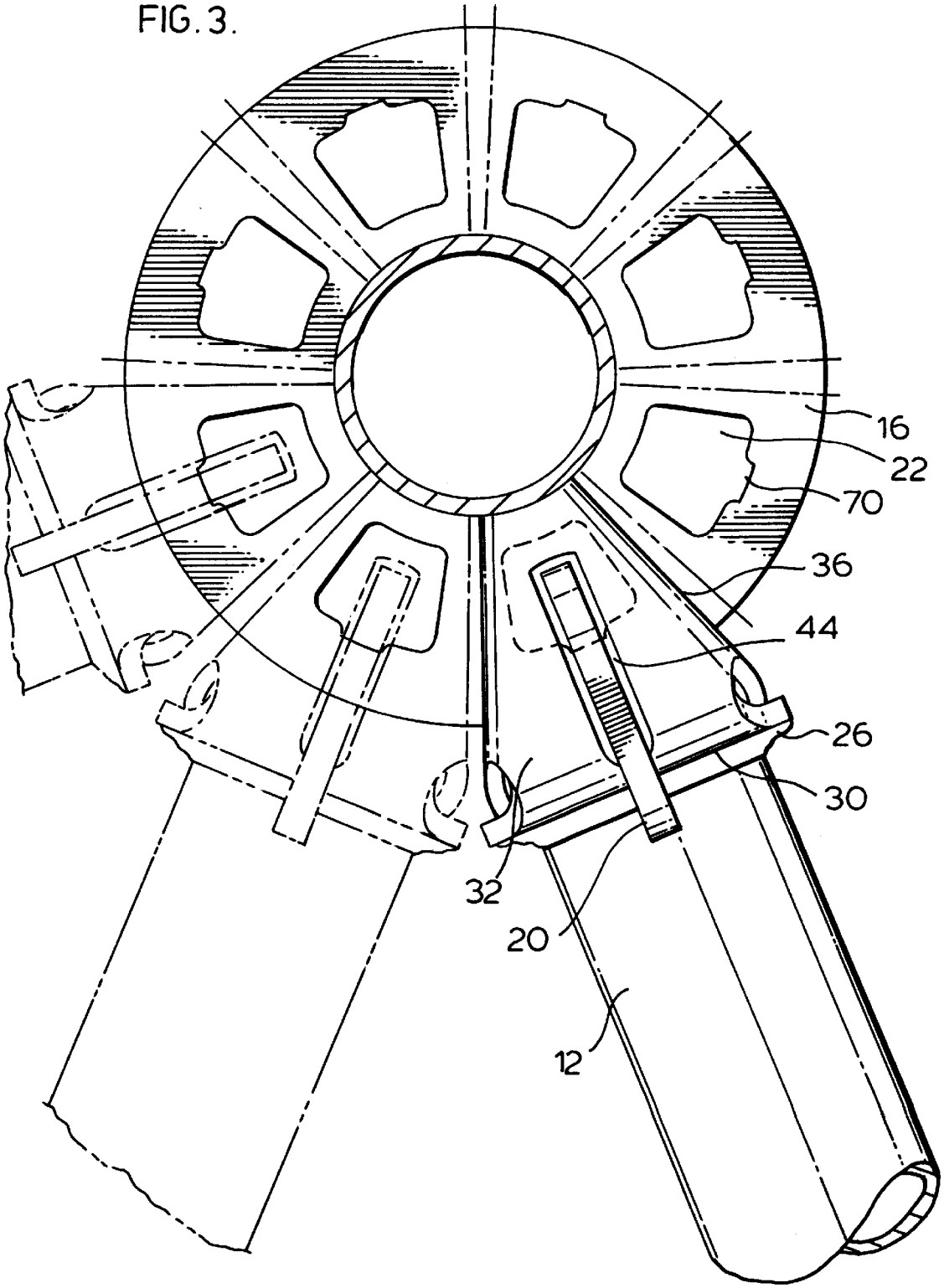
FIG. 3 is a top plan view of a plurality of connectors according to FIG. 1 connected to a vertical post.

As illustrated in the Figures, locking wedge 20 is preferably curved at the lower end thereof, such that when the locking wedge 20 is in the locked position, as illustrated in FIG. 2, the lower end of the locking wedge 20 is spaced away from the vertical post 14. The provision of this shaping of the lower end of the locking wedge 20 aids in the release of the locking wedge 20 when the scaffolding is to be dismantled. In many situations, the locking wedge 20, in order to be released from the locked position, is required to be struck with a suitable tool or implement such as a hammer at the lower end to push the locking wedge 20 upwardly and enable it to be released from engagement with the opening 22 of the locking ring 16. By shaping the lower end of the locking wedge 20 in the manner shown, it is easier for the workmen to have access to this lower end for striking with the tool or implement.

Figure 9:
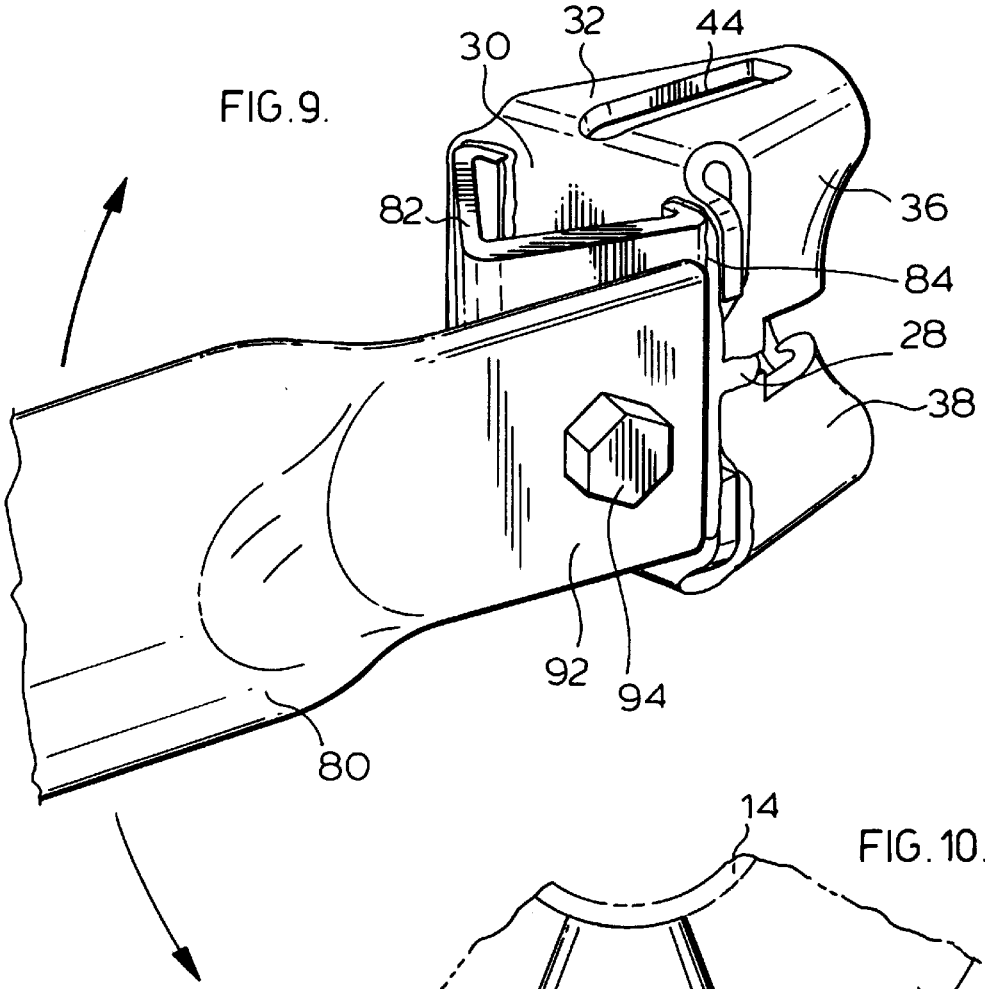
FIG. 9 is a perspective view of an embodiment of the connector of the present invention for use with wind braces.
Figure 10:
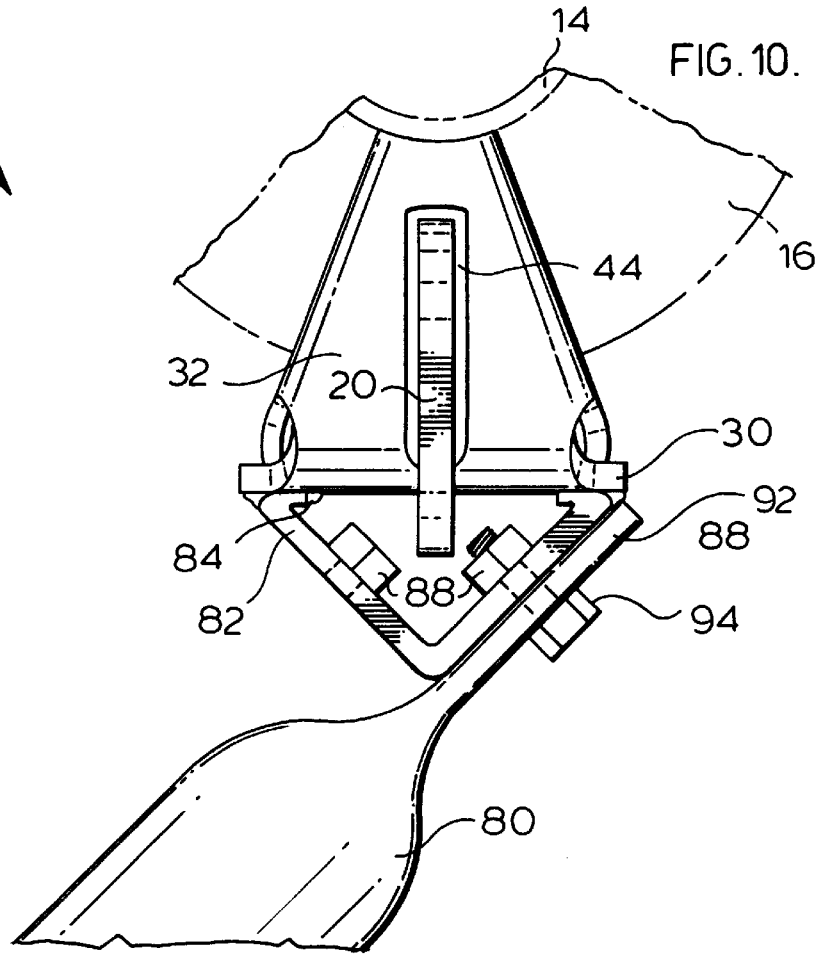
FIG. 10 is a top plan view of the connector of FIG. 9.
Figure 11:
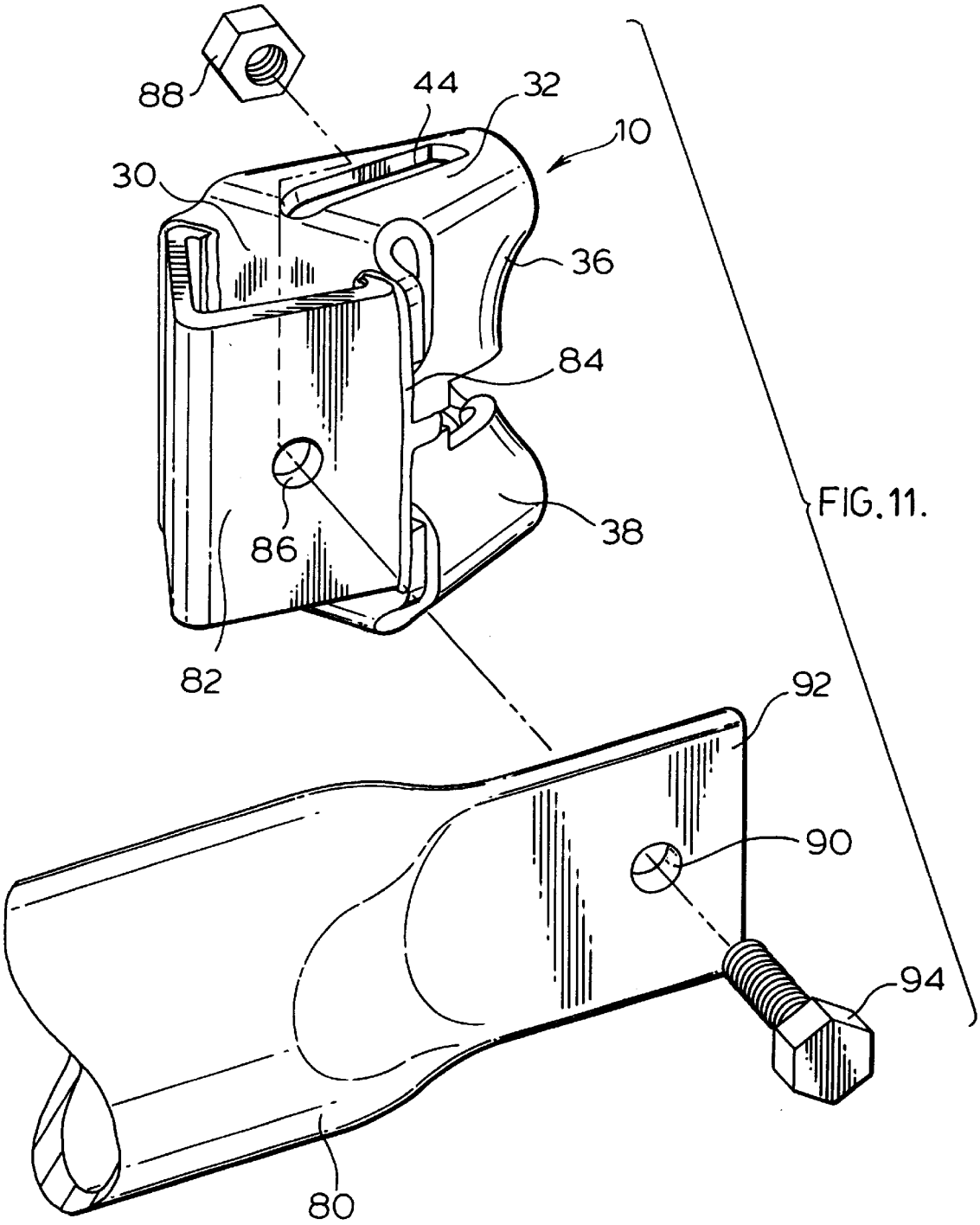
FIG. 11 is an exploded perspective view of the connector of FIG. 9.

As illustrated in FIGS. 9 through 11, connector 10 of the present invention is also suitable for use with windbraces 80. Windbraces 80 are typically arranged to connect vertical posts 14 together diagonally and are required to have variability in the angle between the windbrace 80 and the connector 10. In addition, the connectors 10 and the ends of windbraces 80 generally attach to the locking ring 16 in an offset position and thus the centre line of the connector 10 is generally at an angle with respect to the centre line of the windbrace 80. With the connector 10 of the present invention, these requirements are easily met by the provision of a windbrace adapter 82 to attach to the back plate 30 of the connector 10. Windbrace adapter 82 is a "V" shaped plate which is attached to the back plate 30 by a suitable means such as, for example, by welds 84. The windbrace adapter 82 is preferably formed by bending or folding a suitably dimensioned steel plate, into a shallow legged "U" channel, which is then bent in the opposite direction of the legs to arrive at the general configuration of the "V". The open ends of the "V" are parallel and form a 90 degree relation to backplate 30 of connector. Windbrace adapter 82 is provided with holes 86 on both legs of the V-shaped adapter 82. A suitable nut is placed inside the "V" shape which is shaped so as to secure the nut from rotating. A bolt is placed through the wind brace tube 80, along with a spacer ring and secured tight. The wind brace 80 can now freely move around to the desired angle. As the adapter 82 is provided with holes 86 on either side, the connector 10 with the adapter 82 for use with the windbrace 80 is adaptable to provide either left handed or right handed attachment of the connector to the windbrace 80. This overcomes a problem which has been associated with the prior art windbrace connectors which require separately manufactured right and left hand connectors, such as, for example, those illustrated in U.S. Pat. No. 4,493,578.

By forming the connector 10 of the present invention from the steel plate separate and apart from the horizontal member 12, the advantage of increased strength of the connector 10 is achieved. Thus, the connector 10 of the present invention may be formed from a heavier gauge steel then is typically utilized for formation of the horizontal members. Typically, horizontal members and vertical posts, for scaffolding, are formed from about 0.120 gauge steel. In contrast, the connector 10 of the present invention is preferably formed from a heavier gauge steel, such as, for example, about 0.160 steel plate. By forming the connector 10 from the heavier gauge steel the increased strength of the connector is achieved as compared with connectors formed from the ends of the horizontal members. Connector 10 of the present invention also being formed from folding suitable dimension steel plate is able to be produced at a lower cost than cast connectors, while maintaining the advantages of the strength of the connection achieved by the connector.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A connector for attachment to the end of a horizontal member to releasably secure the horizontal member to a vertical post in a scaffolding system, the connector comprising a suitably dimensioned steel sheet folded and shaped to form a back plate for securement of the connector to the end of the horizontal member, generally triangular shaped top and bottom plates extending outwardly from the back plate and side plates extending downwardly from each side of the top plate and upwardly from each side of the bottom plate to form sides of said connector and wherein said side plates on each side of said connector are secured to each other and said back plate to oppose separation of said top and bottom plates.

2. A connector as claimed in claim 1, wherein the side plates adjacent the back plate are provided with extension wings to join the side plates together, the side plates forward of the extension wings forming a slot for accepting a mounting means on the vertical post for attachment of the connector.

3. A connector as claimed in claim 2, wherein the top and bottom plates are provided with openings for passage of a locking wedge to releaseably secure the connector to the mounting means.

4. A connector as claimed in claim 3, wherein the back plate is provided with alignment means for aligning the connector for securement to the end of the horizontal member.

5. A connector as claimed in claim 1 wherein said side plates are secured to each other by a weld.

6. A connector as claimed in claim 1 wherein said side plates are secured to each other and said back plate by a weld.

7. A horizontal member for use with a vertical post in a post and runner scaffolding system, the horizontal member comprising a metal tube having a connector for releasably securing the horizontal member to the vertical post attached to at least one end of the metal tube, the connector being a hollow connector formed by folding a suitably dimensioned steel sheet, the connector having a back plate attached to the end of the horizontal member, top and bottom plates extending outwardly from the back plate and side plates extending from each side of the top and bottom plates towards the center of the connector to form vertically opposed side of the connector and wherein said side plates on each vertically opposed side of said connector are secured to each other and said back plate to oppose separation of said top and bottom plates.

8. A horizontal member as claimed in claim 7, wherein the side plates of the connector adjacent the back plate are provided with extension wings to join the side plates together, the side plates forward of the extension wings forming a slot for accepting a mounting means on the vertical post for releaseably securing the connector.

9. A horizontal member as claimed in claim 8, wherein the top and bottom plates of the connector are provided with openings for passage of a locking wedge to releaseably secure the connector to the mounting means.

10. A horizontal member as claimed in claim 7 wherein said side plates are secured to each other by a weld.

11. A horizontal member as claimed in claim 7 wherein said side plates are secured to each other and said back plate by a weld.

12. A horizontal member as claimed in claim 11 wherein said metal tube is welded to said back plate.

13. A horizontal member as claimed in claim 7 wherein said metal tube is welded to said back plate.

14. A connector for attachment to a transverse brace of a post and runner scaffolding system, the connector comprising a suitably dimensioned steel sheet folded and shaped to form a back plate, generally triangular shaped top and bottom plates extending outwardly from the back plate and side plates extending downwardly from each side of the top plate and upwardly from each side of the bottom plate to form sides of said connector, the connector having an attachment means for attaching the connector to the transverse brace extending rearwardly from the back plate, the attachment means enabling the connector to be attached to the transverse brace in a left hand or right hand configuration and wherein said side plates on each side of said connector are secured to each other and said back plate to oppose separation of said top and bottom plates.

15. A connector as claimed in claim 14, wherein the side plates adjacent the back plate are provided with extension wings to join the side plates together, the side plates forward of the extension wings forming a slot for accepting a mounting means of a scaffold post.

16. A connector as claimed in claim 15, wherein said connector includes a captured locking wedge and and the top and bottom plates are provided with openings for passage of said locking wedge between a locking position and a release position.

* * * * *